US010822059B2

(12) United States Patent
Miller

(10) Patent No.: US 10,822,059 B2
(45) Date of Patent: Nov. 3, 2020

(54) WATERCRAFT

(71) Applicant: YAMAHA HATSUDOKI KABUSHIKI KAISHA, Shizuoka (JP)

(72) Inventor: Edgar D Miller, Harriman, TN (US)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/295,825

(22) Filed: Mar. 7, 2019

(65) Prior Publication Data

US 2020/0055573 A1 Feb. 20, 2020

Related U.S. Application Data

(63) Continuation of application No. 16/105,776, filed on Aug. 20, 2018.

(51) Int. Cl.

| | |
|---|---|
| ***B63B 17/00*** | (2006.01) |
| ***B63B 27/14*** | (2006.01) |
| ***B63B 34/67*** | (2020.01) |

(52) U.S. Cl.

CPC ..... *B63B 27/14* (2013.01); *B63B 34/67* (2020.02)

(58) Field of Classification Search

CPC ..... B63B 27/14; B63B 27/143; B63B 27/146; B63B 27/16; B63B 2027/14; B63B 2027/141; B63B 2027/143; B63B 2027/146; B63B 2027/16; B63B 35/816; B63B 34/60; B63B 34/63; B63B 34/67

USPC ..... 114/343, 362; 182/84, 92

See application file for complete search history.

(56) References Cited

U.S. PATENT DOCUMENTS

| | | | | |
|---|---|---|---|---|
| 3,195,680 | A * | 7/1965 | Thornburg | B63B 27/14 182/92 |
| 4,462,485 | A * | 7/1984 | Terry | B63B 27/14 114/362 |
| 4,765,438 | A * | 8/1988 | Ritten | B63B 27/14 182/84 |
| 7,121,226 | B2 * | 10/2006 | Grimaldi | B63B 27/14 114/362 |
| 7,900,575 | B2 | 3/2011 | Walbridge et al. | |
| 8,375,880 | B1 | 2/2013 | St. Clair, Jr. et al. | |
| 9,016,228 | B2 * | 4/2015 | Dorton | B63B 27/146 114/343 |
| 9,937,979 | B1 * | 4/2018 | Holmes | B63B 29/02 |

OTHER PUBLICATIONS

Integrated Grab Handle and Ski Tow, 1990.

* cited by examiner

*Primary Examiner* — Daniel V Venne
(74) *Attorney, Agent, or Firm* — Global IP Counselors, LLP

(57) ABSTRACT

A watercraft is basically provided with a watercraft structure and a grab bar. The watercraft structure includes a platform with a recess at a rear edge of the platform. The grab bar is mounted to the watercraft structure in the recess of the platform. The grab bar has a bar portion with a front edge that is disposed forward of the rear edge of the platform with respect to a front to aft direction of the watercraft.

20 Claims, 14 Drawing Sheets

WATERCRAFT

CROSS-REFERENCE TO RELATED APPLICATIONS

This application is a continuation application of U.S. patent application Ser. No. 16/105,776 filed on Aug. 20, 2018. The entire disclosure of U.S. patent application Ser. No. 16/105,776 is hereby incorporated herein by reference.

BACKGROUND

Field of the Invention

This invention generally relates to the field of watercrafts. More specifically, the present invention relates to a watercraft having a platform that is deployable between two different positions at a rear end of watercraft.

Background Information

Watercrafts (e.g., boats) are used for many purposes. Often people spending time swimming around the rear end of their watercraft. Some watercrafts are provided with swimming platforms on the transom to make it easier to get into and out of the watercraft as well as making the watercraft more enjoyable to use. Also, some watercrafts are provided with a ski tow hook so that a person can participate in water sports, such as a wakeboarding, a wakesurfing, waterskiing and the like. In such surface water sports, a rider is towed directly behind a watercraft using a tow rope that is attached to the watercraft.

SUMMARY

Generally, the present disclosure is directed to various features of a watercraft.

In view of the state of the known technology and in accordance with one aspect of the present disclosure, a watercraft is basically provided with a watercraft structure and a grab bar. The watercraft structure includes a platform with a recess at a rear edge of the platform. The grab bar is mounted to the watercraft structure in the recess of the platform. The grab bar has a bar portion with a front edge that is disposed forward of the rear edge of the platform with respect to a front to aft direction of the watercraft.

Also, other features, aspects and advantages of the disclosed watercraft will become apparent to those skilled in the field of manufacturing watercrafts from the following detailed description, which, taken in conjunction with the annexed drawings, discloses several illustrative embodiments of a watercraft with various features.

BRIEF DESCRIPTION OF THE DRAWINGS

Referring now to the attached drawings which form a part of this original disclosure.

Figure 1:
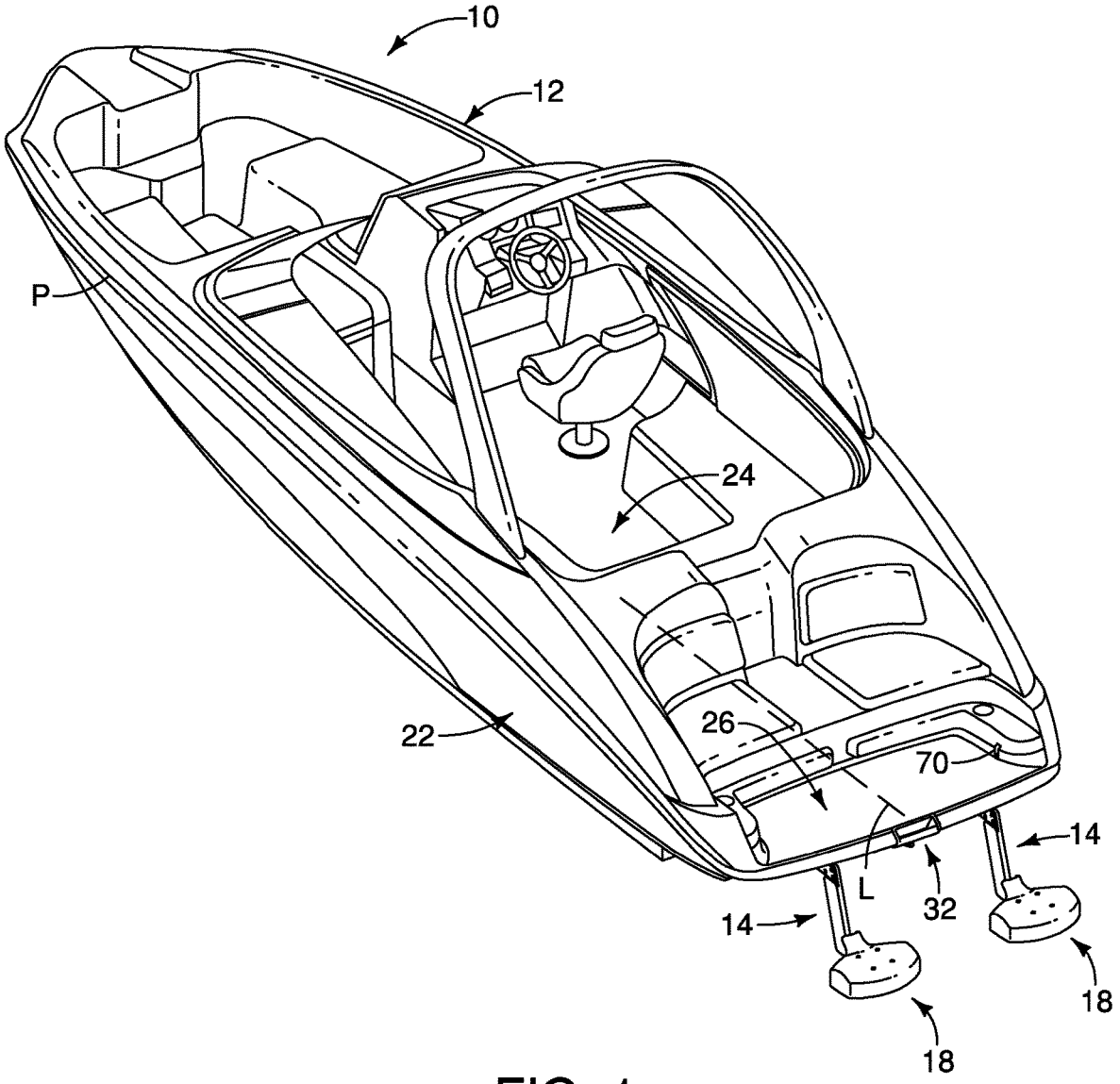
FIG. 1 is a rear perspective view of a watercraft (i.e., a jet boat) in accordance with a first embodiment, in which the watercraft includes a pair of platform assemblies that are each in a first deployed position (a seat position) and a ladder in the stowed position.

It should be noted that these figures are intended to illustrate the general characteristics of methods, structure and/or materials utilized in certain illustrative embodiments and to supplement the written description provided below. These drawings are not, however, to scale and may not precisely reflect the precise structural or performance characteristics of any given embodiment, and should not be interpreted as defining or limiting the range of values or properties encompassed by illustrative embodiments. The use of similar or identical reference numbers in the various drawings is intended to indicate the presence of a similar or identical element or feature.

DETAILED DESCRIPTION OF EMBODIMENTS

Selected embodiments will now be explained with reference to the drawings. It will be apparent to those skilled in the watercraft field from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

Referring initially to FIG. 1, a watercraft 10 is illustrated in accordance with a first embodiment. In the first embodiment, the watercraft 10 comprises a watercraft structure 12 and a pair of platform assemblies 14. The platform assemblies 14 are provided at the rear end of the watercraft structure 12 for selectively providing below water level seating (e.g., a pair of swim seats) and above water lever support areas (e.g., a pair of tables). As discussed later in more detail, each of the platform assemblies 14 basically includes a platform mount 16 and a platform 18.

As seen in FIG. 1, the watercraft 10 is a jet boat that is propelled by water jets ejected from the rear end of the watercraft 10. The watercraft 10 comprises a watercraft structure 12 that basically includes a hull 22, a deck 24 and a swim platform 26. The hull 22, the deck 24, the swim platform 26 and the other parts of the watercraft 10 are made of suitable materials that are typically used in boats for a marine environment, for example, and thus, the materials of the various parts of the watercraft 10 will not be discussed herein. Also, in the first embodiment, the watercraft structure 12 includes a rub rail 30 that is disposed along at least a rear portion of the watercraft structure 12. Namely, the rub rail 30 is disposed at least along a rear edge of the swim platform 26. In the first embodiment, a grab bar 32 is mounted to the watercraft structure 12. In particular, the grab bar 32 is mounted in a recess **26*a* of the swim platform 26 (see FIGS. 20 to 30). The recess 26*a* is at least partially defined by the rub raft 30. The watercraft structure 12 defines an outer top boat perimeter P. Here, the grab bar 32 includes a tow hook 34 as seen in FIGS. 20 to 30** and as discussed below.

As seen in FIGS. 2 to 6, a step ladder 36 is provided mounted to the watercraft structure 12 beneath the swim platform 26. The step ladder 36 is retractable from an in-use position shown in FIGS. 2 to 6 to a stowed position shown in FIG. 1. The step ladder 36 is mounted along a longitudinal center line L of the watercraft 10. Here, the step ladder 36 is aligned in a vertical plane with the grab bar 32 such that a person using the step ladder 36 can grip the grab bar 32.

Figure 3:
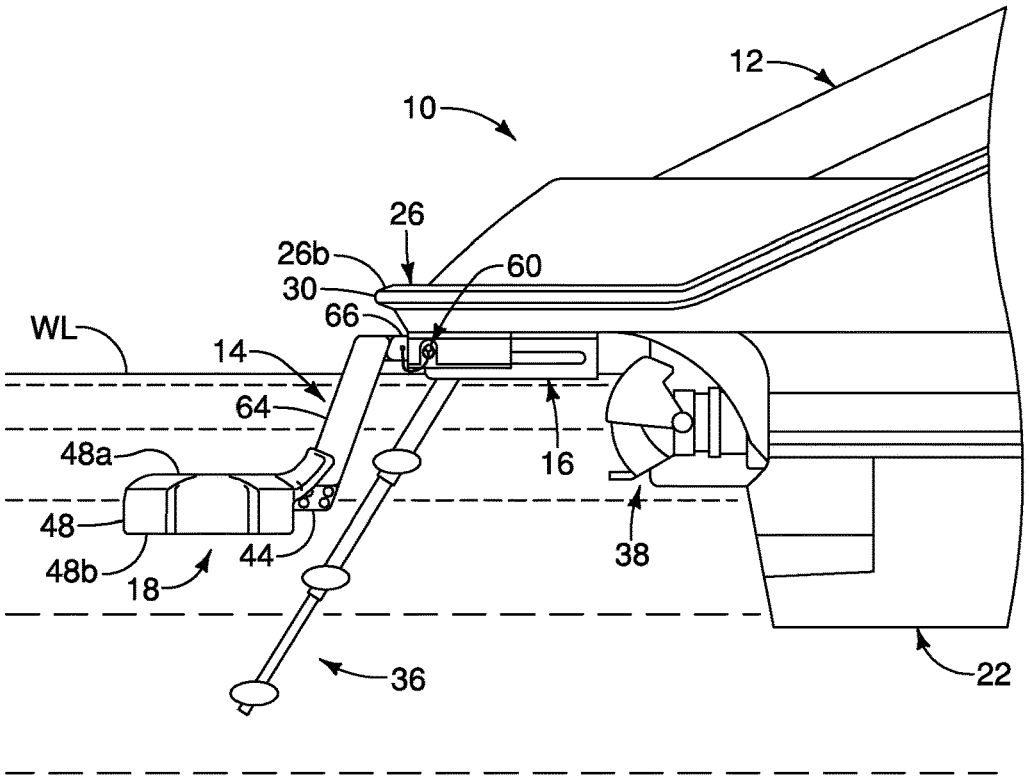
FIG. 3 is a partial side elevational view of the rear end (stern) of the watercraft illustrated in FIGS. 1 and 2 with the platform assemblies in the first deployed positions (the seat positions) and the ladder in the in-use position.

As seen in FIG. 3, the watercraft 10 further comprises a jet propulsion unit 38 that generates propulsion force or, thrust to propel the watercraft 10 in a conventional manner. Since jet propulsion units such as the jet propulsion unit 38 are well known in the watercraft field, the jet propulsion unit 38 will not be discussed in detail herein.

As seen in FIGS. 2 to 6, the platform mount 16 of each of the platform assemblies 14 is identical, except for their mounting locations on the watercraft structure 12. Thus, the same reference numeral will be used to describe each of the platform assemblies 14. Each of platform assemblies 14 is provided on the watercraft structure 12. More specifically, the platform mount 16 of each of the platform assemblies 14 is mounted beneath the swim platform 26. The platform mount 16 are fastened to a lower surface of the swim platform 26 by a plurality of fasteners (not shown). The platform assemblies 14 are laterally spaced from the longitudinal center line L of the watercraft 10.

Figure 4:
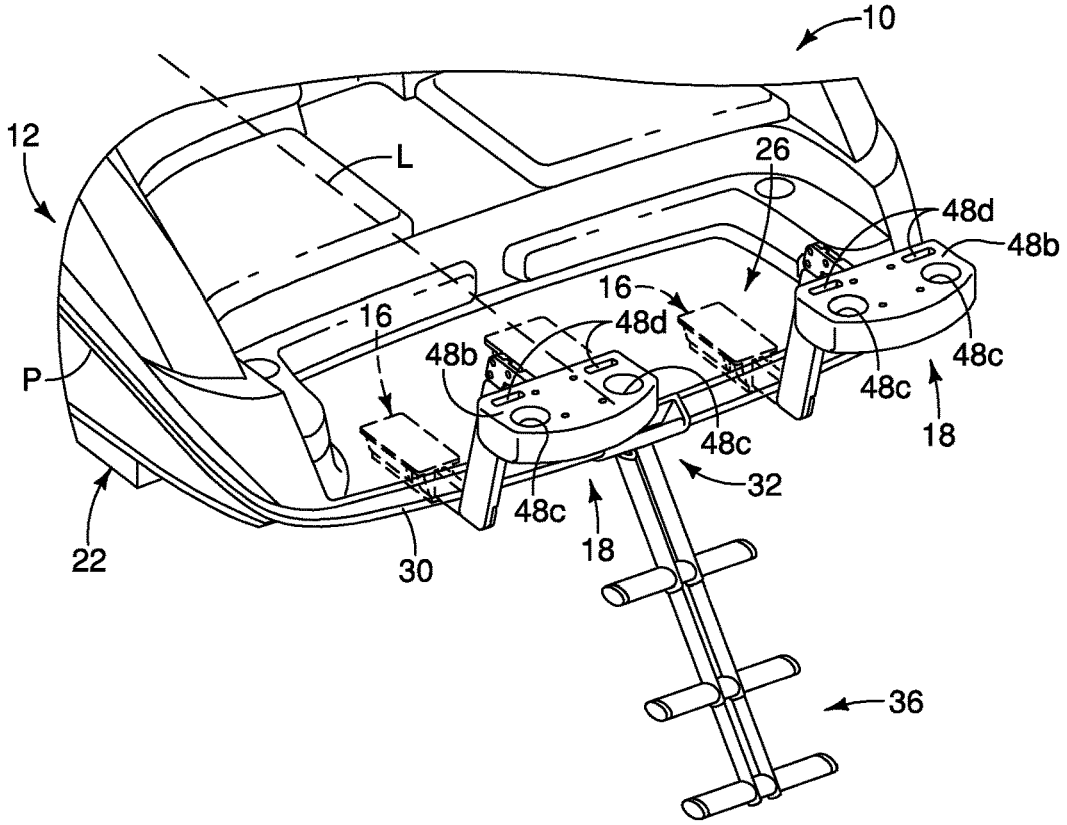
FIG. 4 is a partial rear perspective view of the rear end (stern) of the watercraft illustrated in FIGS. 1 to 3 with the platform assemblies each in a second deployed position (a table position) and the ladder in an in-use position.
Figure 5:
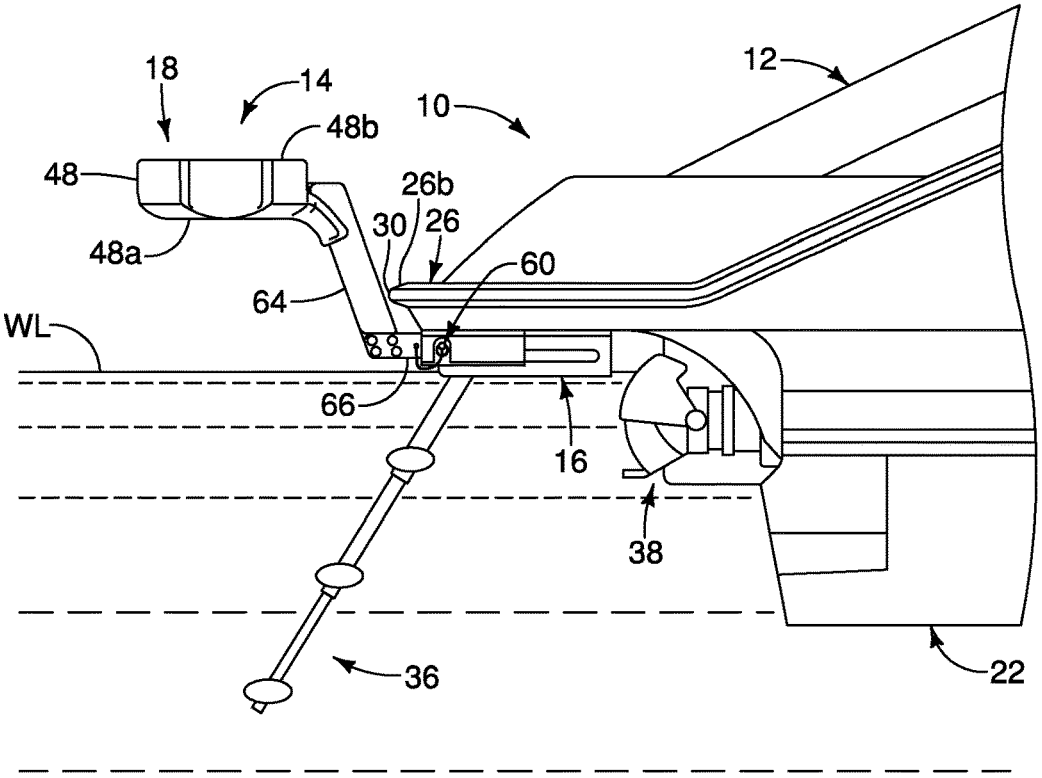
FIG. 5 is a partial side elevational view of the rear end (stern) of the watercraft illustrated to FIGS. 1 to 4 with the platform assemblies in the second deployed positions (the table positions) and the ladder in the in-use position.
Figure 6:
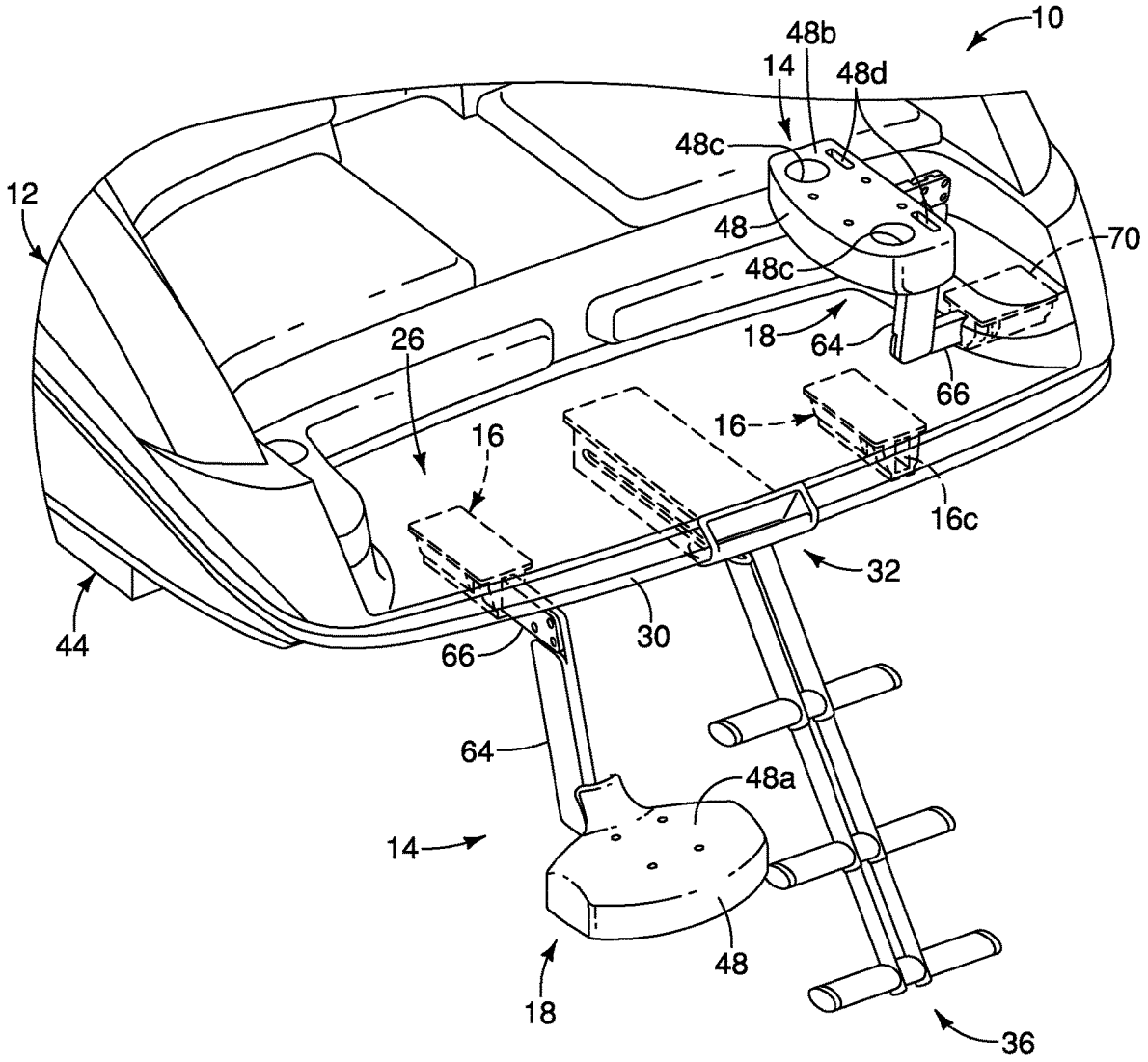
FIG. 6 is a partial rear perspective view of the rear end (stern) of the watercraft illustrated in FIGS. 1 to 5 with one of the platform assemblies in the first deployed position (the seat position), the other of the platform assemblies in a third deployed position (an in-boat table position) and the ladder in an in-use position.
Figure 7:
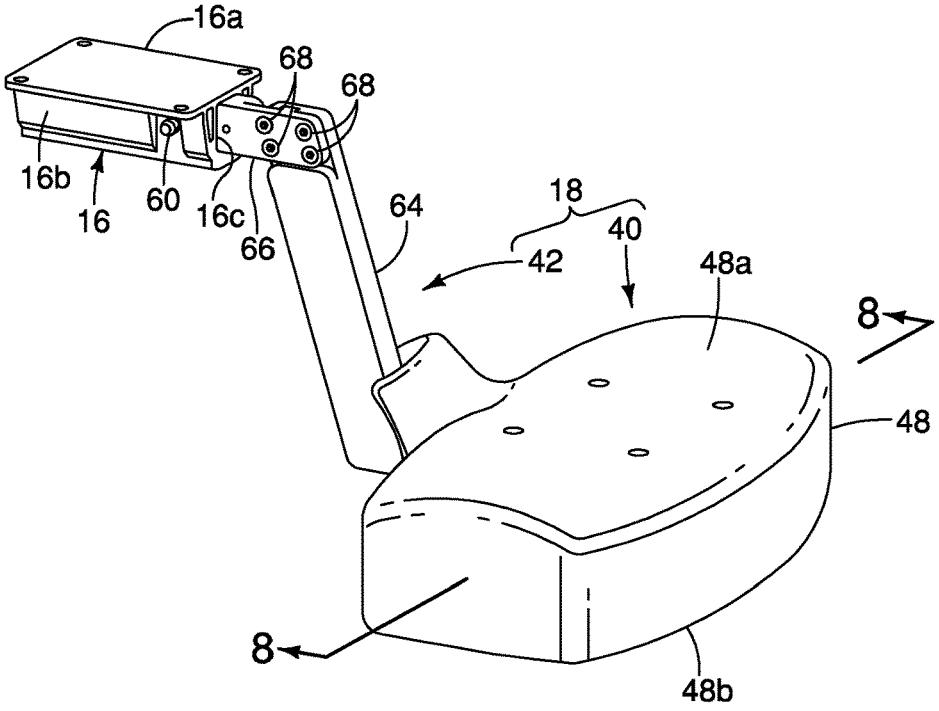
FIG. 7 is a rear perspective view of one of the platform assemblies illustrated in FIGS. 1 to 6 and disposed in the first deployed position (the seat position) before mounting to the watercraft.

The platform mount 16 is preferably made of a metallic material that is suitable for a marine environment. The platform mount 16 includes a mounting plate **16*a* and a support 16*b*. Here, the mounting plate 16*a* and the support 16*b* are integrally formed as a one-piece member. The support 16*b* of the platform mount 16 includes a support receiving recess 16*c*. The platform 18 is detachably received in the support receiving recess 16*c*. In this way, the platform 18 can be removed from the platform mount 16 and then reinstalled in the platform mount 16 such that the platform 18 can be switched between a first deployed position (FIGS. 2 and 3) and a second deployed position (FIGS. 4 and 5). Here, in the first embodiment, the first deployed position corresponds to a swim seat position and the second deployed position corresponds to a table position. In the first deployed position, the platform 18 is primarily disposed below the water level WL. On the other hand, the platform 18 is primarily disposed above the water level WL while in the second deployed position. The support receiving recess 16*c* of the platform mount 16 has a non-circular cross section. For example, the non-circular cross section of the support receiving recess 16*c* is rectangular. In this way, the first and second deployed positions can be effectively easily established. The support 16***b* of the platform mount 16 also includes a pair of openings 16*d* that are used for detachably securing the platform 18 to the platform mount 16.

Figure 2:
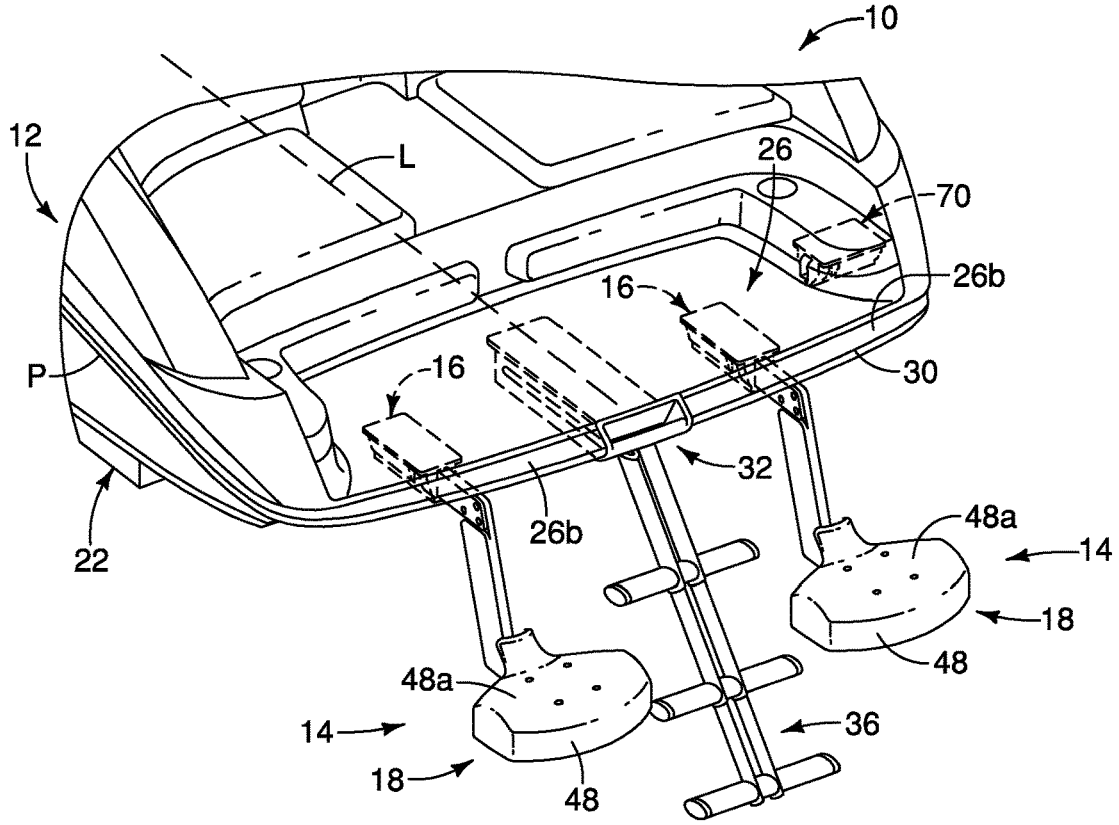
FIG. 2 is a partial rear perspective view of a rear end (stern) of the watercraft illustrated in FIG. 1 with the platform assemblies in the first deployed positions (the seat positions) and the ladder in an in-use position.

In the first embodiment, the platform 18 basically includes a platform portion 40 and a support portion 42. Basically, the support portion 42 is coupled to the platform mount 16 to selectively support the platform portion 40 in either the first deployed position and the second deployed position. In other words, the support portion 42 is detachably and selectively coupled to the platform mount 16 in the first deployed position and the second deployed position. The platform portion 40 is disposed rearward of the swim platform 26 in each of the first and second deployed positions, while the support portion 42 is coupled to the platform mount 16 in each of the first and second deployed positions. As seen in FIGS. 2 and 3, the platform portion 40 is disposed below the platform mount 16 while the support portion 42 is coupled to the platform mount 16 in a first deployed position that is outside of the outer top boat perimeter. As seen in FIGS. 4 and 5, the platform portion 40 is disposed above the platform mount 16 while the support portion 42 is coupled to the platform mount 16 in a second deployed position that is outside of the outer top boat perimeter.

In the first embodiment, for example, the platform portion 40 includes a brace 44, an inner frame 46 and an outer platform shell 48. The brace 44 is a rigid beam that has one end attached to the support portion 42 so that the brace 44 is cantilevered with respect to the support portion 42. The brace 44 is preferably made of a rigid metallic material that is suitable for a marine environment. Here, for example, the brace 44 is rigidly secured to the support portion 42 by a plurality of fasteners 50 such as screws. The inner frame 46 is rigidly secured to the brace 44 by a plurality of fasteners 52 such as screws. The outer platform shell 48 is constructed of a non-metallic material such as a plastic material that is attached to the inner frame 46 and/or the outer platform shell 48. For example, the outer platform shell 48 can be over molded onto the inner frame 46 and/or the outer platform shell 48 or attached by a plurality of fasteners.

The outer platform shell 48 of the platform portion 40 includes a seat side surface 48*a* and a table side surface 48*b*. The seat side surface 48*a* faces in an opposite direction to the table side surface 48*b*. The table side surface 48*b* preferably includes one or more recesses for receiving various items. The table side surface 48*b* includes, a recessed portion. For example, the table side surface 48*b* includes at least one cup holder 48*c*. Here, as seen in FIG. 4, the table side surface 48*b* includes two of the cup holders 48*c* for holding cups, and a pair of elongated recesses 48*d* for holding other items such as a cell phone.

Figure 8:
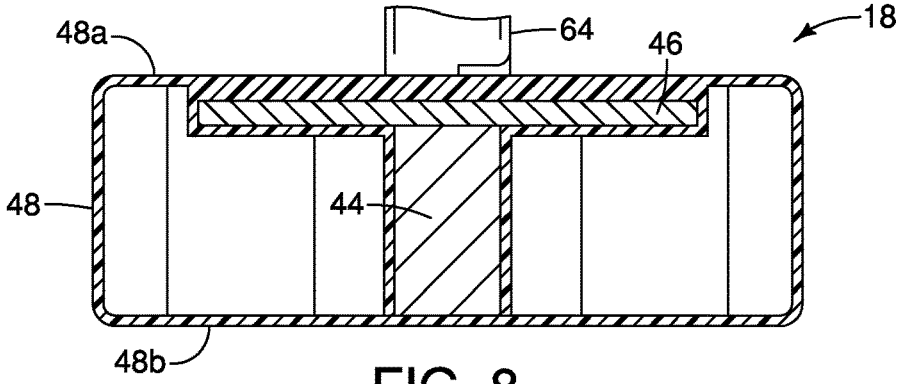
FIG. 8 is a transverse cross-sectional view of the platform of the platform assembly illustrated in FIG. 7 as seen along section line 7-7 of FIG. 7 and showing a hollow interior of the platform portion.
Figure 9:
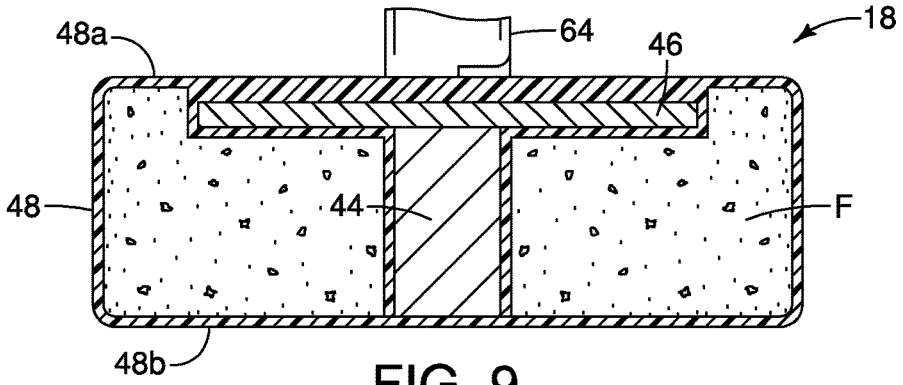
FIG. 9 is an alternate transverse cross-sectional view of the platform of the platform assembly illustrated in FIG. 7 as seen along section line 7-7 of FIG. 7 and showing a foam filled interior of the platform portion.
Figure 10:
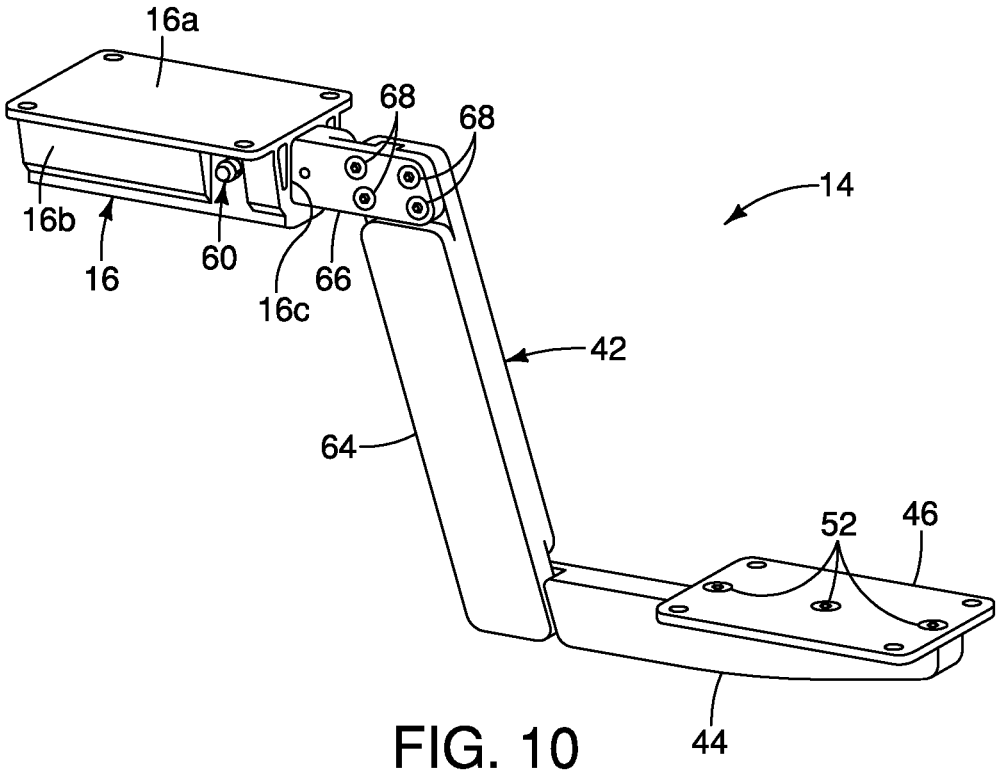
FIG. 10 is a perspective view of the platform assembly illustrated in FIG. 7 with an outer platform shell of the platform portion removed.
Figure 11:
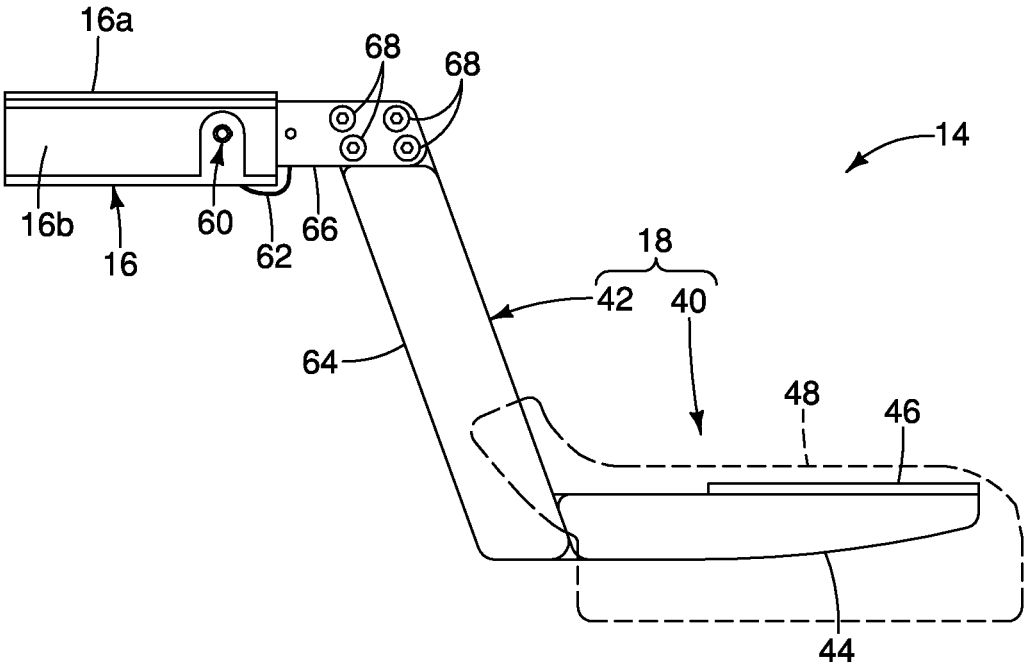
FIG. 11 is a first side devotional view of the platform assembly illustrated in FIG. 10 with the outer platform shell of the platform portion shown in dashed lines.
Figure 12:
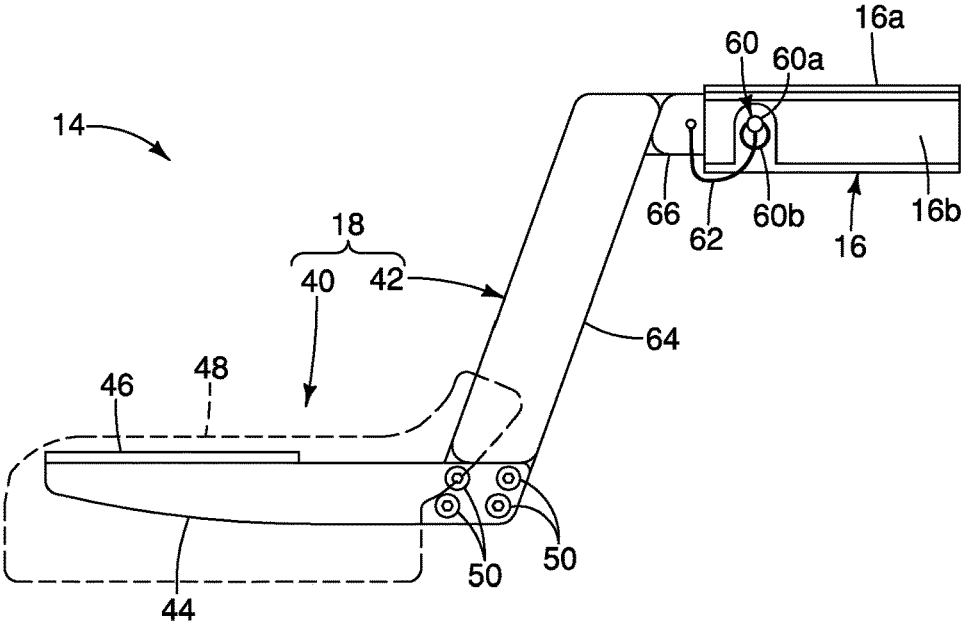
FIG. 12 is a second side elevational view of the platform assembly illustrated in FIGS. 10 and 11 with the outer platform of the platform portion shown in dashed lines.
Figure 13:
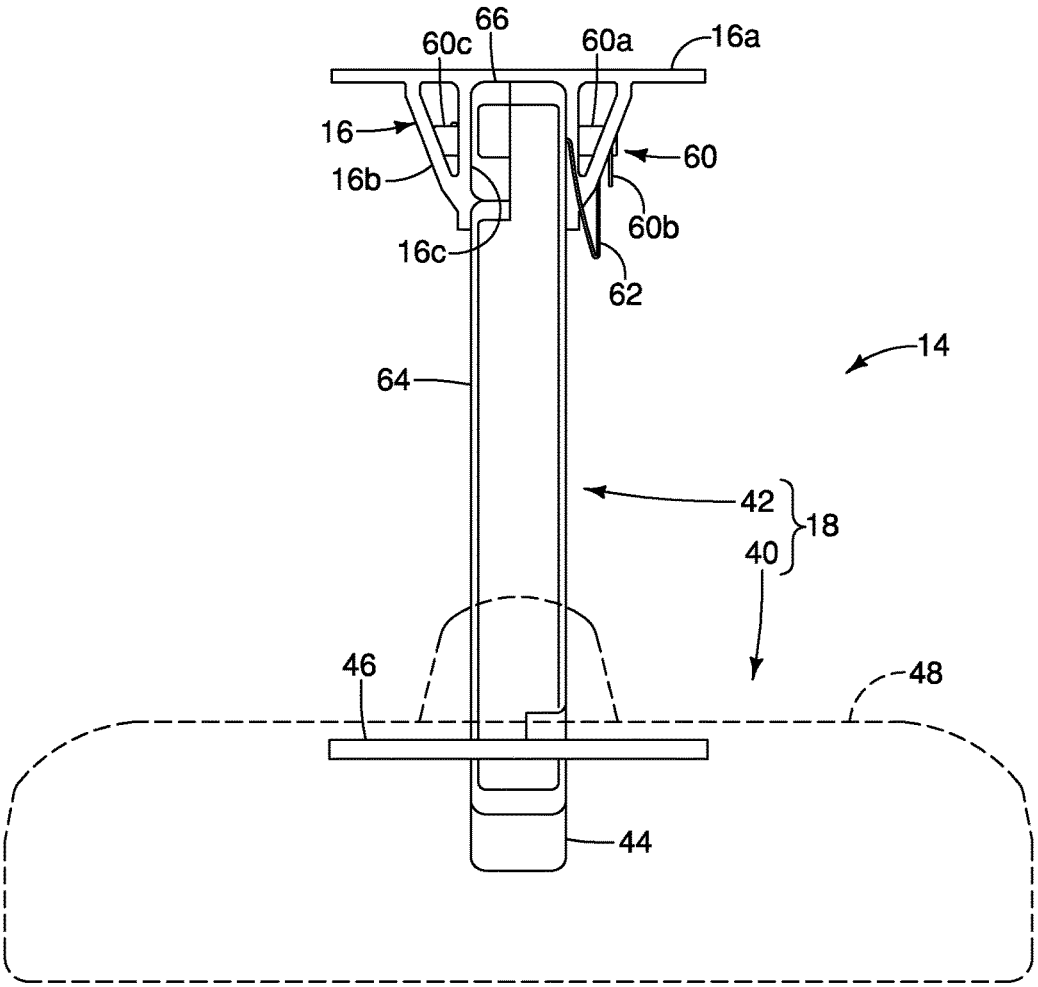
FIG. 13 is a rear end elevational view of the platform assembly illustrated in FIGS. 10 to 12 with the outer platform of the platform portion shown in dashed lines.
Figure 14:
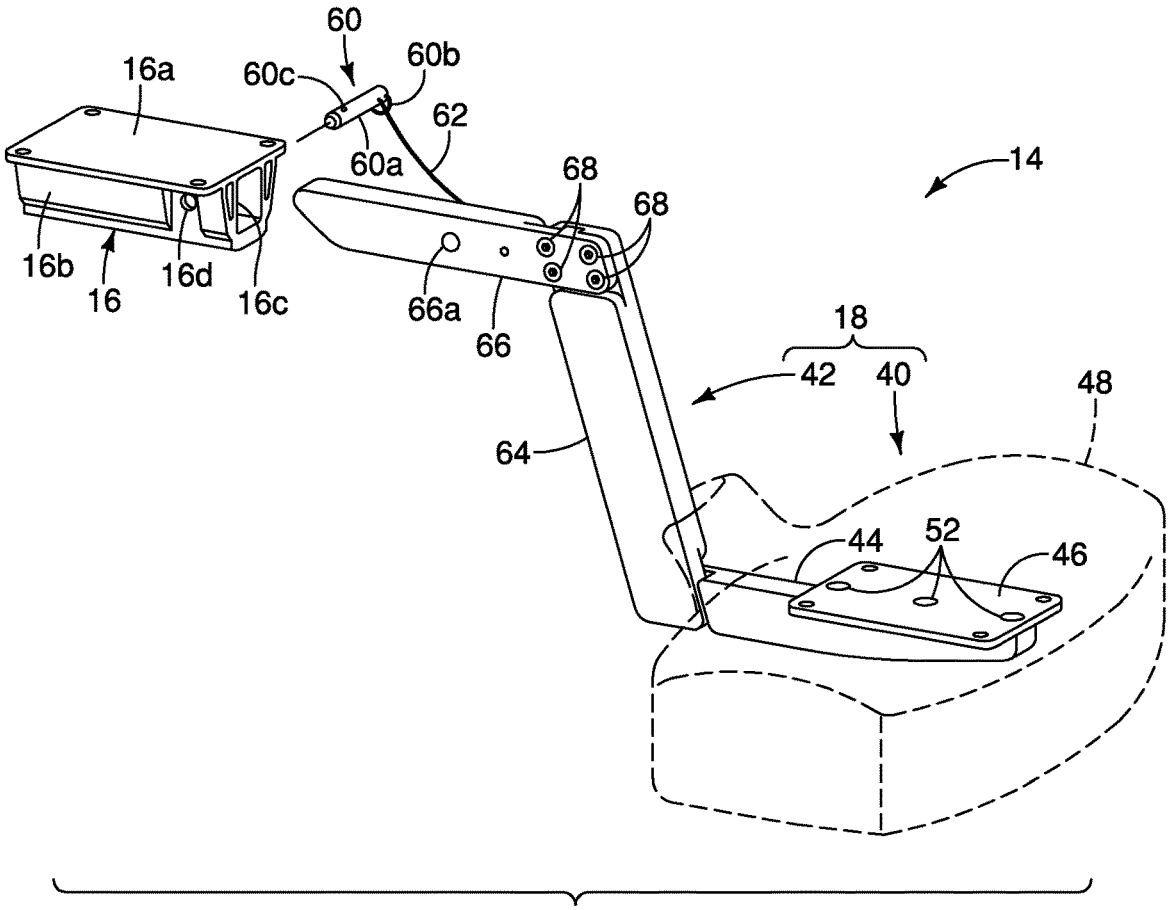
FIG. 14 is a partially exploded perspective view of the platform assembly illustrated in FIGS. 10 to 13 with the outer platform of the platform portion removed.
Figure 15:
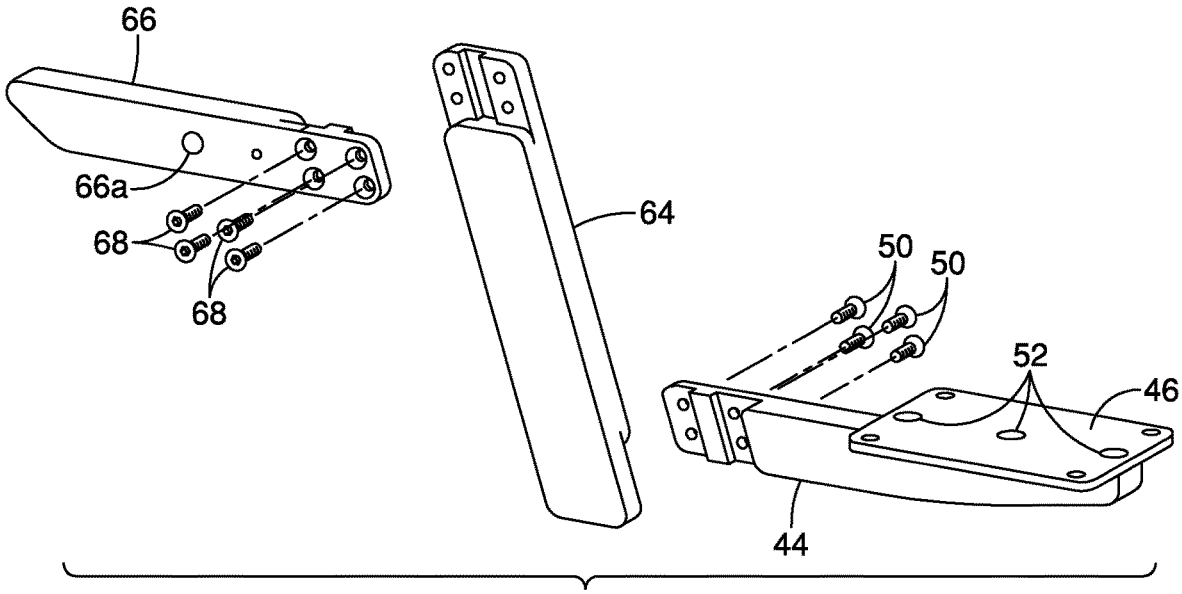
FIG. 15 is a further exploded perspective view of selected parts of the platform assembly illustrated in FIGS. 10 to 14.
Figure 16:
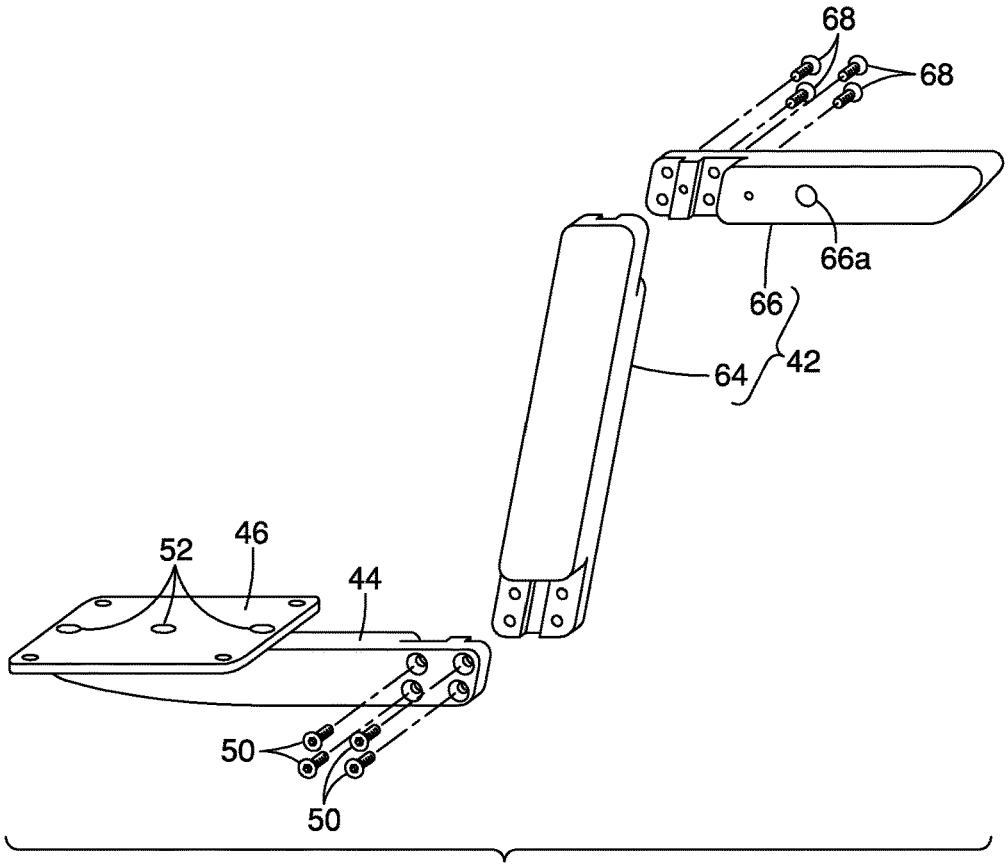
FIG. 16 is a further exploded perspective view of the selected parts of the platform assembly illustrated in FIG. 15.

Preferably, the platform 18 is configured to float in water. In this way, platform 18 is drop into the water, the platform 18 will not sink to the bottom. For example, as seen in FIG. 8, the platform 18 includes a hollow area to provide buoyance such that the platform floats in the water. Alternatively, as seen in FIG. 9 the platform 18 includes a material less dense than the water such that the platform floats in the water. For example, the platform 18 can be provided with a foam material F as seen in FIG. 9.

As mentioned above, the support portion 42 is detachably coupled to the platform mount 16. In the first embodiment, for example, at least one toolless fastener 60 is provided for detachably securing the support portion 42 to the platform mount 16. Here, only a single toolless fastener is used. In any case, the toolless fastener 60 selectively fixes the support portion 42 to the platform mount 16 in the first and second deployed positions. The tool less fastener 60, for example, includes a quick release pin 60*a* having a handle portion 60*b* at a first end of the quick release pin 60*a* and a detent 60*c* at a second end of the quick release pin 60*a*. Here, the detent 60*c* is a spring biased member that projects radially from the quick release pin 60*a*. The quick release pin 60*a* is inserted through the openings 16*d* of the support 16*b* of the platform mount 16 for detachably securing the platform 18 to the platform mount 16. Preferably, a tether 62 extends between the support portion 42 and the quick release pin 60*a*. In this way, the quick release pin 60*a* remains with the platform 18, and does not get lost. Alternatively, the quick release pin 60*a* can be tethered to the platform mount 16 or the bottom surface of the swim platform 26.

In the first embodiment, the support portion 42 has a generally L-shaped configuration that includes an elongated leg 64 and an attachment part 66. The elongated leg 64 and the attachment part 66 are preferably made of a rigid metallic material that is suitable for a marine environment. Here, for example, the elongated leg 64 is rigidly secured to the attachment part 66 by a plurality of fasteners 68 such as screws. Alternatively, the elongated leg 64 and the attachment part 66 can be formed as a one-piece member. Preferably, the elongated leg 64 is inclined with respect to the platform mount 16 and the platform portion 40. However, the elongated leg 64 can be perpendicular to the platform mount 16 and the platform portion 40. In either case, the platform mount 16 and the platform portion 40 extends in opposite directions with respect to the elongated leg 64. In the first embodiment, the attachment part 66 and the platform portion 40 are parallel. The attachment part 66 of the support portion 42 has a non-circular cross section, and the support receiving recess 16*c* of the platform mount 16 has a mating shape that mates with the attachment part 66 of the support portion 42 to selectively establish the first and second deployed positions. In other words, the support receiving recess 16*c* receives the attachment part 66 of the support portion 42 to selectively establish the first and second deployed positions. In the first embodiment, the non-circular cross section of the attachment part 66 is rectangular, and the support receiving recess of the platform mount 16 is rectangular. However, it will be apparent from this disclosure that other mating shapes can be used to selectively establish the first and second deployed positions. The attachment part 66 is provided with a hole 66*a* that receives the quick release pin 60*a* when the attachment part 66 is disposed in the support receiving recess 16*c*. Thus, the quick release pin 60*a* extends through the openings 16*d* in the platform mount 16 and the hole 66*a* in the attachment part 66 for fixing the platform 18 to the platform mount 16.

The platform assemblies 14 each includes an additional platform mount 70 (only one illustrated) that is provided on the watercraft structure 12 at a location inside the outer top boat perimeter P. In the first embodiment, the additional platform mount 70 is identical to the platform mount 16. However, the additional platform mount 70 does not necessarily need to be identical to the platform mount 16. However, the additional platform mount 70 should be designed to support the platform 18 when the platform 18 is not installed in the platform mount 16. In the first embodiment, the additional platform mount 70 is configured and arranged to support the platform 18 so that the platform portion 40 can be used as a table that is located inside the watercraft 10. In particular, the support portion 42 is detachably and selectively coupled to the additional platform mount 70 in a third deployed position in which the platform portion 40 is spaced directly above a deck of the watercraft structure 12. The toolless fastener 60 is used to fix the support portion 42 to the additional platform mount 70 in the third deployed position.

Figure 17:
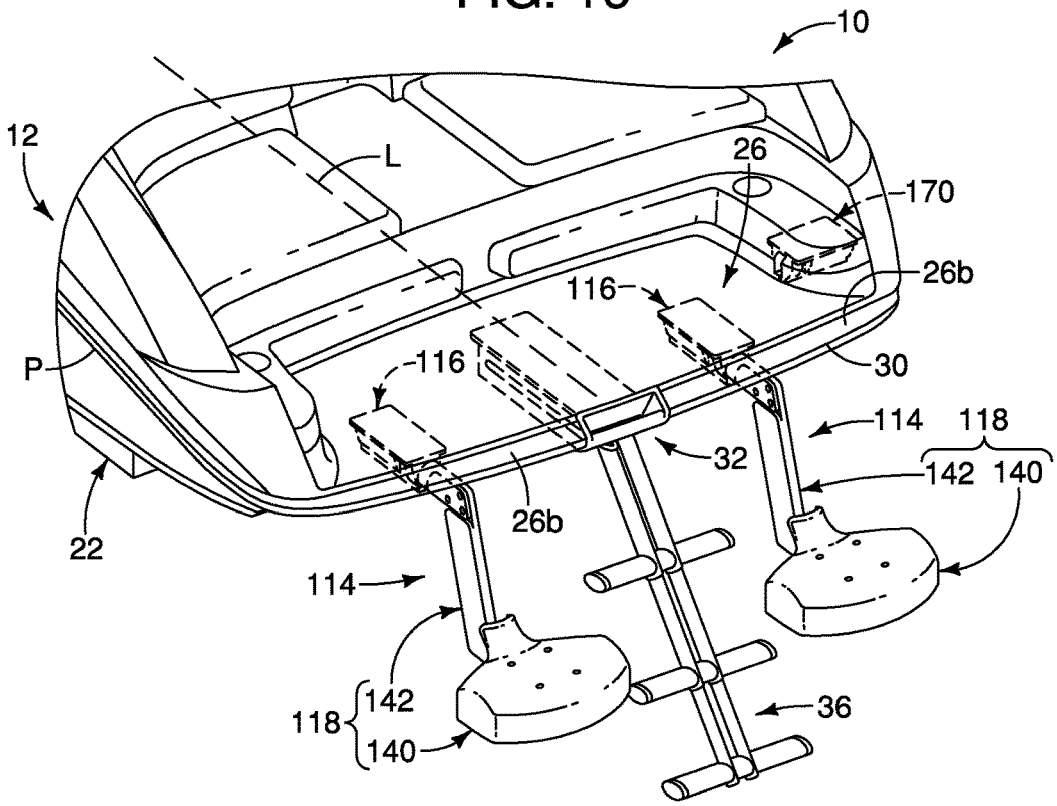
FIG. 17 is a partial rear perspective view of the rear end (stern) of the watercraft illustrated in FIG. 1 with a pair of platform assemblies in accordance with a second embodiment, in which the platform assemblies are in the first deployed positions (the seat positions)
Figure 18:
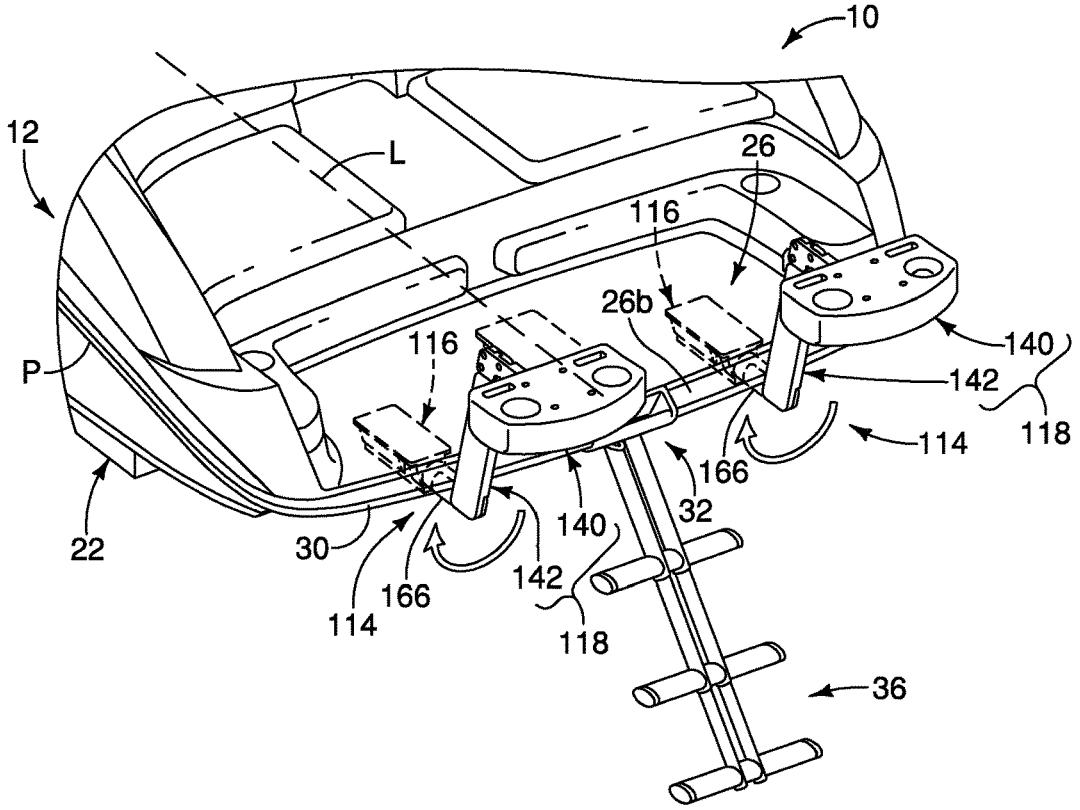
FIG. 18 is a partial rear perspective view of the rear end (stern) of the watercraft illustrated in FIG. 17 with the platform assemblies in the second deployed positions (the table positions)
Figure 19:
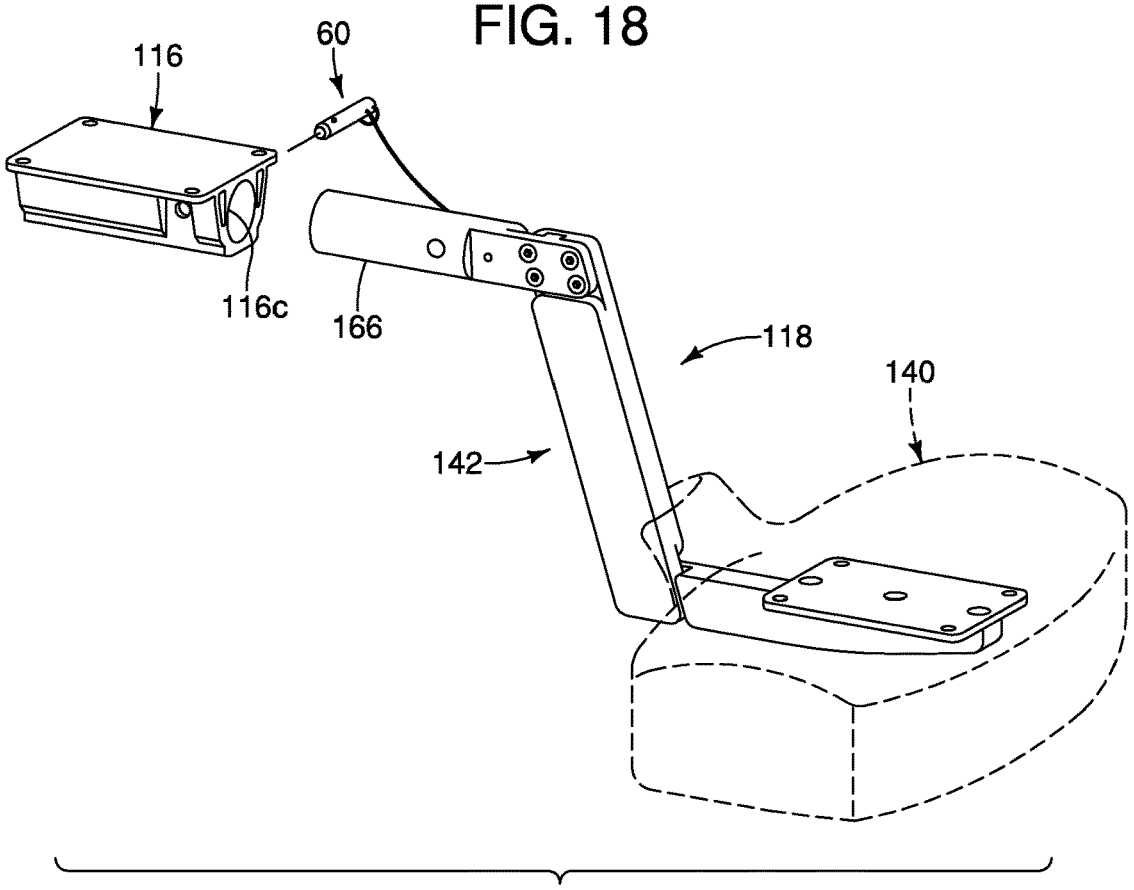
FIG. 19 is a perspective view of one of the platform assemblies illustrated in FIGS. 17 and 18 with the outer platform of the platform portion removed.

Referring now to FIGS. 17 to 19, the watercraft 10 has been modified such that the platform assemblies 14 have been replaced with alternate platform assemblies 114 in accordance with a second embodiment will now be explained. In view of the similarity between the first and second embodiments, the descriptions of the parts of the second embodiment that are identical to the parts of the first embodiment may be omitted for the sake of brevity. Each of the platform assemblies 114 basically includes a platform mount 116 and a platform 118. The platform mount 116 is identical to the platform mount 16, discussed above, except that the platform mount 116 has a support receiving recess 116*c* that has a circular cross section. In the second embodiment, the platform 118 basically includes a platform portion 140 and a support portion 142. The platform portion 140 is identical to the platform portion 40. On the other hand, the support portion 142 is identical to the support portion 42, discussed above, except that the support portion 142 has an attachment part 166 that has a circular cross section.

Thus, the support portion 142 is rotatably coupled to the platform mount 116 to selectively establish the first and second deployed positions by rotating the support portion 142 180° relative to the platform mount 116 without completely detaching the support portion 142 from the platform mount 116. In other words, the support receiving recess 116*c* rotatably receives the attachment part 166 of the support portion 142. Preferably, the toolless fastener 60 is used to selectively fix the platform 118 to the platform mount 116 in the first and second deployed positions.

Also, in the second embodiment, the watercraft 10 has been modified such that the additional platform mounts 70 have been replaced with additional platform mount 170 that are identical to the platform mounts 116.

Figure 20:
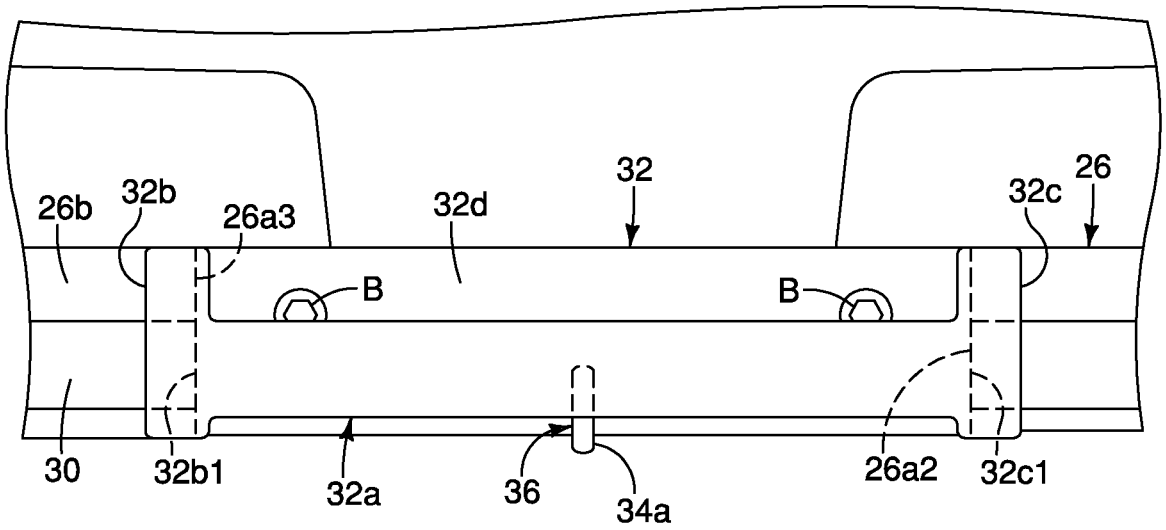
FIG. 20 is a partial rear elevational view of the rear end (stern) of the watercraft illustrated in FIG. 1 in a center area in which a grab bar and a tow hook is installed.
Figure 21:
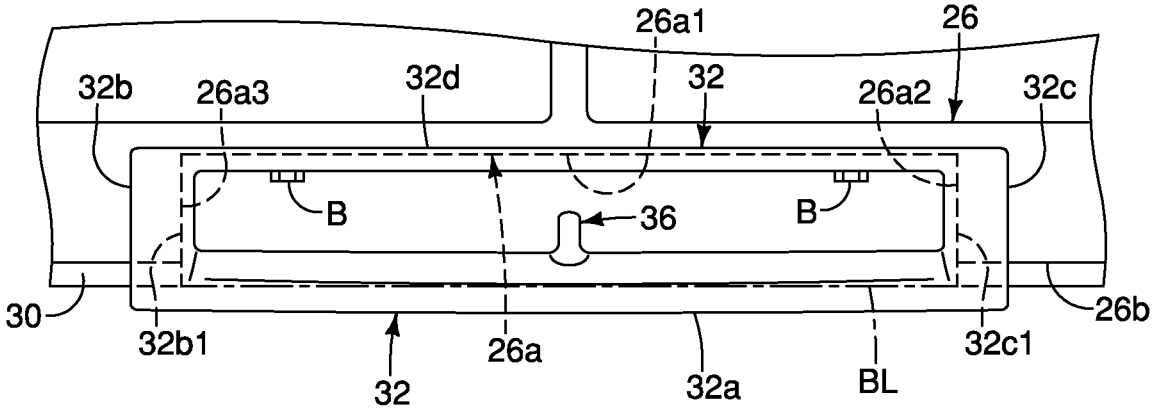
FIG. 21 is a partial top plan view of the rear end (stern) of the watercraft illustrated in FIG. 1 shown the grab bar and the tow hook from above.
Figure 22:
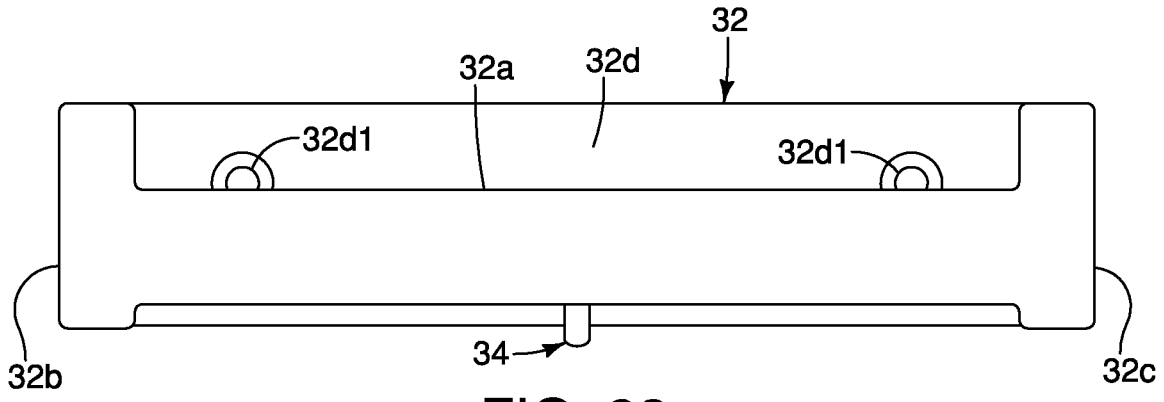
FIG. 22 is a front surface devational view of the grab bar and the tow hook illustrated in FIGS. 1, 20 and 21, but separated from the watercraft, in accordance with our new design.
Figure 23:
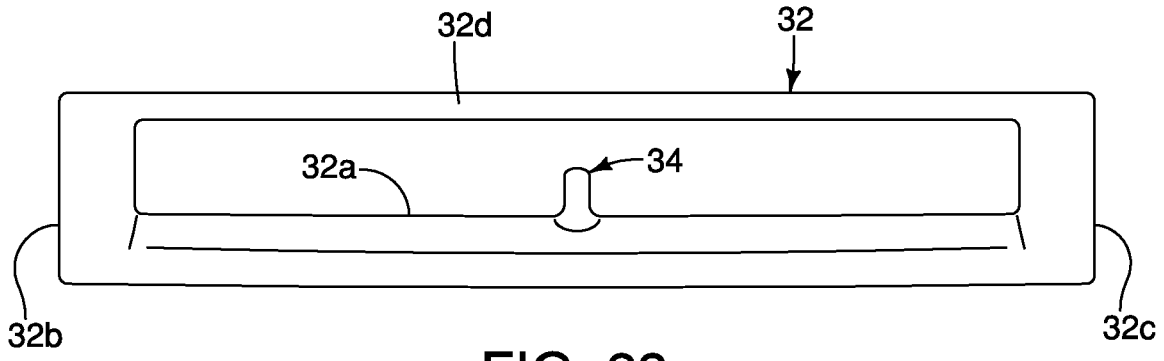
FIG. 23 is a top plan view of the grab bar and the tow hook illustrated in FIG. 22 in accordance with our new design.
Figure 24:
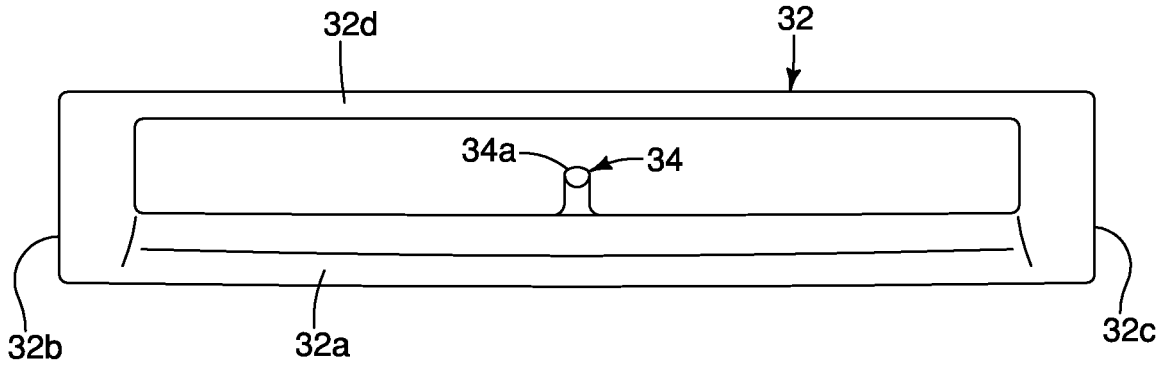
FIG. 24 is a bottom plan view of the grab bar and the tow hook illustrated in FIGS. 22 and 23 in accordance with our new design.
Figure 25:
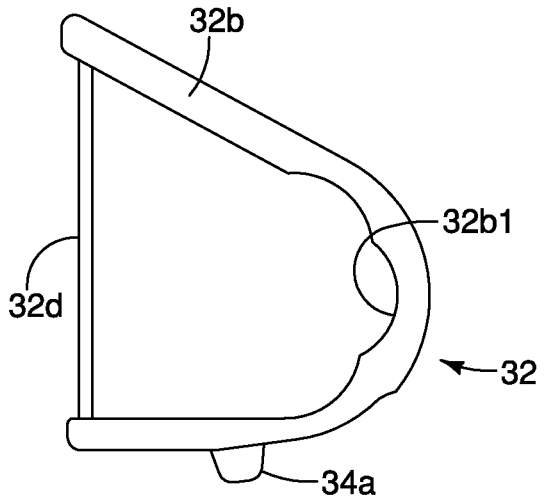
FIG. 25 is a left end view of the grab bar and the tow hook illustrated in FIGS. 22 to 24 in accordance with our new design.
Figure 26:
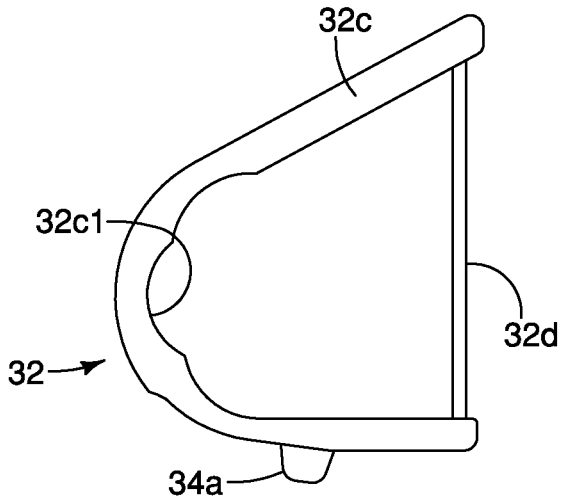
FIG. 26 is a right end view of the grab bar and the tow hook illustrated in FIGS. 22 to 25 in accordance with our new design.
Figure 27:
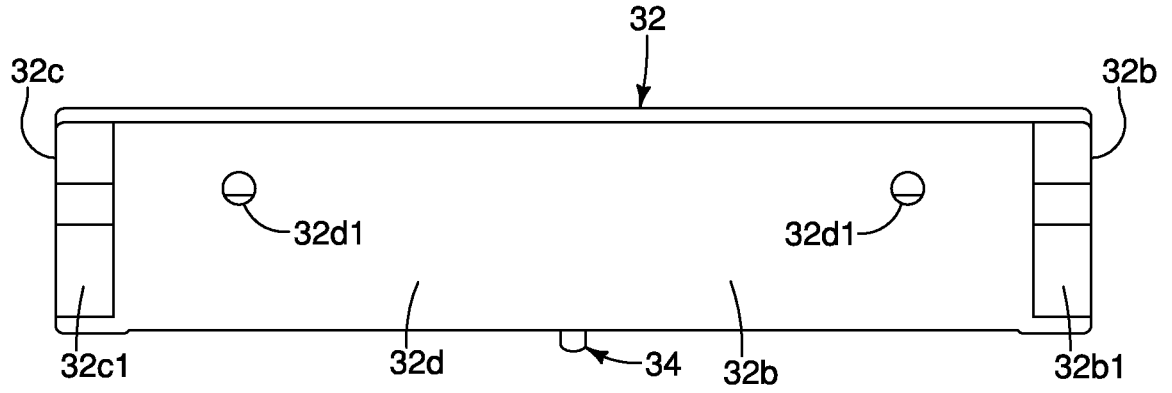
FIG. 27 is a rear surface elevational view of the grab bar and the tow hook illustrated in FIGS. 22 to 26 in accordance with our new design.
Figure 28:
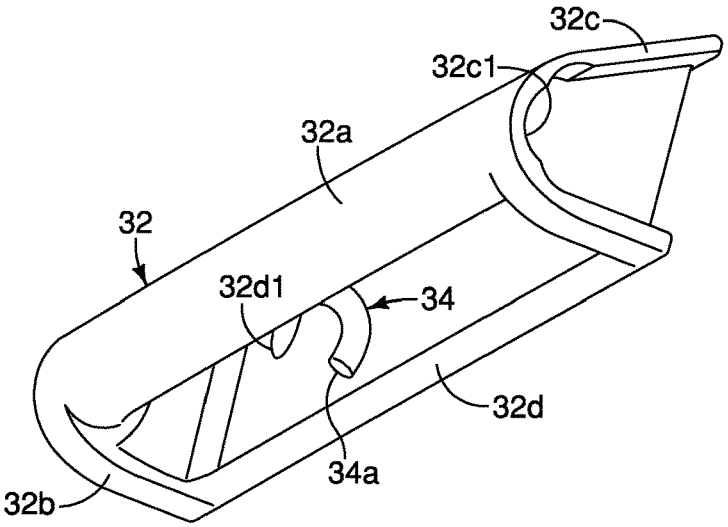
FIG. 28 is a first perspective view of the grab bar and the tow hook illustrated in FIGS. 22 to 27 in accordance with our new design.
Figure 29:
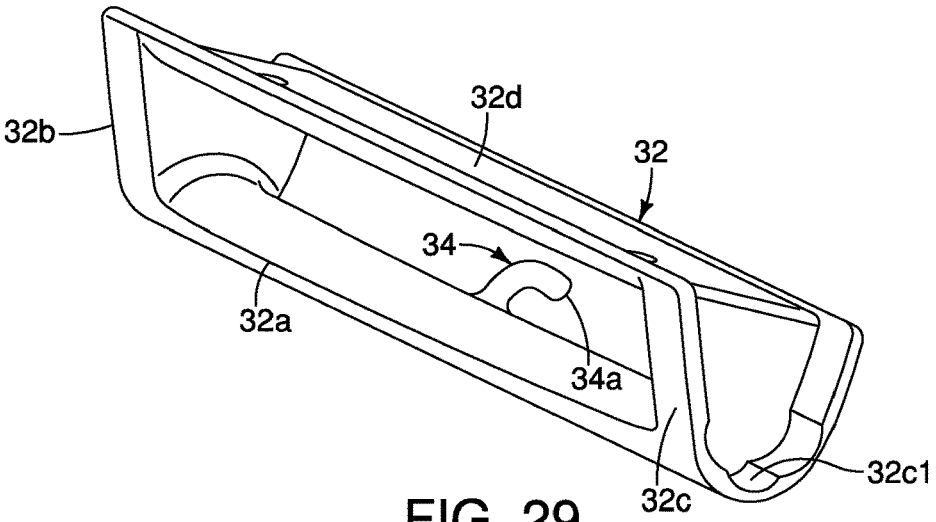
FIG. 29 is a first perspective view of the grab bar and the tow hook illustrated in FIGS. 22 to 28 in accordance with our new design.
Figure 30:
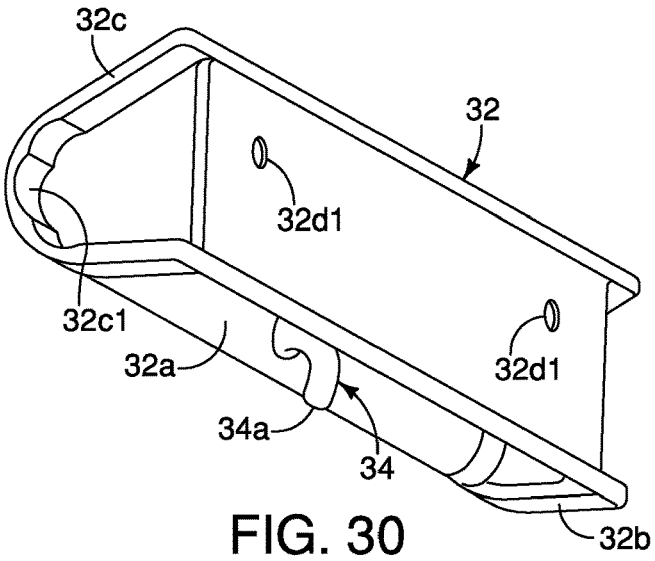
FIG. 30 is a first perspective view of the grab bar and the tow hook illustrated in FIGS. 22 to 29 in accordance with our new design.

Referring now to FIGS. 20 to 30, the grab bar 32 will now be discussed in more detail. As mentioned above, the grab bar 32 is fixedly mounted to a rear portion of the watercraft structure 12. Preferably, as mentioned above, the grab bar 32 is disposed in the recess 26*a* of the swim platform 26. Here, the grab bar 32 is configured to overlap at each lateral end with a rear edge 26*b* of the swim platform 26 and the rub rail 30. The recess 26*a* has a rearwardly facing surface 26*a*1, and a pair of oppositely facing lateral surfaces 26*a*2 and 26*a*3 as seen in FIGS. 20 and 21.

Here, the grab bar 32 basically includes a bar portion 32*a*, a first end portion 32*b*, a second end portion 32*c* and a mounting portion 32*d*. The bar portion 32*a* extends along a rearward boundary of the recess 26*a* as indicated by a boundary line BL as seen in FIG. 21. The rearward boundary of the recess 26*a* is defined by a rear edge of the rear portion of the watercraft structure 12. The bar portion 32*a* and the mounting portion 32*d* extends laterally between the first and second end portions 32*b* and 32*c*. The tow hook 34 is fixed to the bar portion 32*a*. Preferably, the tow hook 34 is located at the midpoint of the bar portion 32*a* with respect to the lateral direction of the watercraft 10. The tow hook 34 is configured to curve downwardly to a free end 34*a*. The first end portion 32*b* is provided with a first recess 32*b*1 and the second end portion 32*c* is provided with a second recess 32*c*1. The first recess 32*b*1 and the second recess 32*c*1 are configured to recess a portion of the rear edge 26*b* of the swim platform 26 and a portion of the rub rail 30. In this way, the ends of the rear edge 26*b* and the rub rail 30 that define the recess 26*a* are hidden by the first and second end portions 32*b* and 32*c*. The mounting portion 32*d* is provided with a pair of fastener openings 32*d*1. Two mounting bolts B are used to secure the grab bar 32 to the swim platform 26.

An ornamental design is disclosed for a grab bar (i.e., the grab bar 32 having the tow hook 34) as in shown in FIGS. 20 to 30 that is used with the watercraft 10 and is described above. In the ornamental design, the hidden surfaces are not part of ornamental design. In particular, the surfaces defining the first and second recesses 32*b*1 and 32*c*1 do not form not part of ornamental design. Likewise, the mounting surface of the mounting portion 32*d* that faces the watercraft 10 does not form not part of ornamental design. Also, the fastener openings 32*d*1 do not form not part of ornamental design.

In one feature, a watercraft is provided in which a platform is provided a platform that is deployable between two different positions at a rear end of watercraft. In another feature, a watercraft is provided in which a combination grab bar and tow hook is provided at a rear end of watercraft.

In accordance with one aspect of the present disclosure, a watercraft is provided that basically comprises a watercraft structure, a platform mount and a platform. The watercraft structure defines an outer top boat perimeter. The platform mount is provided on the watercraft structure. The platform includes a platform portion and a support portion coupled to the platform mount. The platform portion is disposed below the platform mount while the support portion is coupled to the platform mount in a first deployed position that is outside of the outer top boat perimeter. The platform portion is disposed above the platform mount while the support portion is coupled to the platform mount in a second deployed position that is outside of the outer top boat perimeter. With the watercraft according to this aspect, it is possible to a versatile platform that can be used for sitting in the water or as a table.

In accordance with another aspect of the present disclosure, a watercraft is provided that basically comprises a watercraft structure and a grab bar. The watercraft structure includes a rear portion of the watercraft structure. The grab bar is mounted to the watercraft structure in a recess of the rear portion of the watercraft structure. The grab bar includes a tow hook. With the watercraft according to this aspect, it is possible to integrate a grab bar and a tow hook into the watercraft such that it does not interfere with the use of the rear end of the watercraft.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Thus, as used herein, the singular forms "a," "an" and "the" are intended to include the plural forms as well, unless the context clearly indicates otherwise. Also, the terms "part," "section," "portion," "member" or "element" when used in the singular can have the dual meaning of a single part or a plurality of parts. Unless otherwise defined, all terms (including technical and scientific terms) used herein have the same meaning as commonly understood by one of ordinary skill in the art to which illustrative embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

It will be understood that when an element is referred to as being "connected" or "coupled" to another element, it can be directly connected or coupled to the other element or intervening elements may be present. In contrast, when an element is referred to as being "directly connected" or "directly coupled"" to another element, there are no intervening elements present. As used herein the term "and/or" includes any and all combinations of one or more of the associated listed items. Additionally, similar words used to describe the relationship between elements or layers should be interpreted in a like fashion (e.g., "between" versus "directly between", "above" versus "directly above", "below" versus "directly below", "adjacent" versus "directly adjacent," "on" versus "directly on"). Thus, components that are shown directly connected or contacting each other can have intermediate structures disposed between them unless specified otherwise.

It will be understood that, although the terms "first", "second", etc. may be used herein to describe various elements, components, regions, layers, positions and/or sections, these elements, components, regions, layers, positions and/or sections should not be limited by these terms. These terms are only used to distinguish one element, component, region, layer, position or section from another element, component, region, layer, position or section. Thus, a first element, component, region, layer, position or section discussed above could be termed a second element, component, region, layer, position or section without departing from the teachings of illustrative embodiments.

Spatially relative terms, such as "forward", "rearward", "above", "below", "beneath", "downward", "vertical", "horizontal", and "transverse" as well as any other similar spatial terms may be used herein for the ease of description to describe one element or feature's relationship to another element(s) or feature(s) of the above embodiments. These terms, as utilized to describe the present invention should be interpreted relative to a watercraft floating in calm water.

The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A watercraft comprising:

a watercraft structure including a platform with a recess at a rear edge of the platform, and a rub rail attached to the platform, the rub rail having end portions that are spaced apart from each other in a lateral direction of the watercraft;

a grab bar mounted to the watercraft structure in the recess of the platform, the grab bar having a bar portion with a front edge that is disposed forward of the rear edge of the platform with respect to a front to aft direction of the watercraft, and first and second end portions with first and second recesses, respectively; and a step ladder mounted to the watercraft structure, the grab bar being disposed directly above the step ladder, and the first and second recesses of the first and second end portions of the grab bar covering the end portions of the rub rail, respectively.

2. The watercraft according to claim 1, wherein the bar portion is spaced from a rearwardly facing surface of the recess to define an opening that is entirely disposed forward of the rear edge of the platform with respect to the front to aft direction of the watercraft.

3. A watercraft comprising:

a watercraft structure including a platform with a recess at a rear edge of the platform; and a grab bar mounted to the watercraft structure in the recess of the platform, the grab bar having a bar portion with a front edge that is disposed forward of the rear edge of the platform with respect to a front to aft direction of the watercraft, the bar portion being spaced from a rearwardly facing surface of the recess to define an opening that is entirely disposed forward of the rear edge of the platform with respect to the front to aft direction of the watercraft, the grab bar having a tow hook that is located in the opening.

4. The watercraft according to claim 3, wherein the bar portion is aligned with the rear edge of the platform in a lateral direction of the watercraft along the recess.

5. The watercraft according to claim 4, wherein the bar portion is partially located in the recess and partially located rearward of the rear edge of the platform with respect to the front to aft direction of the watercraft.

6. The watercraft according to claim 3, wherein the watercraft structure includes a rub rail that is attached to the platform to form a rear edge of the watercraft structure, and the grab bar covers an end portion of the rub rail.

7. The watercraft according to claim 3, wherein the watercraft structure includes a rub rail that is attached to the platform to form a rear edge of the watercraft structure, and the grab bar covers end portions of the rub rail, respectively.

8. The watercraft according to claim 3, wherein the tow hook is fixed to the bar portion.

9. The watercraft according to claim 8, wherein the tow hook is located at a midpoint of the bar portion.

10. The watercraft according to claim 8, wherein the tow hook curves downwardly to a free end thereof.

11. The watercraft according to claim 3, further comprising a step ladder mounted to the watercraft structure, the grab bar being disposed above the step ladder.

12. The watercraft according to claim 11, wherein the step ladder is aligned with the grab bar in a vertical plane of the watercraft that is parallel to a longitudinal center line of the watercraft.

13. The watercraft according to claim 3, wherein
the bar portion extends in a lateral direction of the watercraft.

14. The watercraft according to claim 3, wherein
at least half of the bar portion is disposed forward of a rear edge of the watercraft structure with respect to the front to aft direction of the watercraft.

15. The watercraft according to claim 3, wherein
the grab bar further has a mounting portion and first and second end portions, the bar portion and the mounting portion extending laterally between the first and second end portions.

16. The watercraft according to claim 15, wherein
the first and second end portions are provided with first and second recesses, respectively, and
the first and second recesses of the first and second end portions cover end portions of the rear edge of the platform, respectively.

17. The watercraft according to claim 15, wherein
the mounting portion has a fastener opening for securing the grab bar to the platform.

18. A watercraft comprising:
a watercraft structure including
a platform with a recess at an outer top boat perimeter of the watercraft structure, and
a rub rail attached to the platform, the rub rail having end portions that are spaced apart from each other in a lateral direction of the watercraft; and
a grab bar mounted to the watercraft structure in the recess, the grab bar having
a bar portion with an inside edge that is disposed inboard of the watercraft with respect to the outer top boat perimeter of the watercraft structure, and
first and second end portions with first and second recesses, respectively,
the grab bar being disposed at a center of a rear portion of the watercraft structure with respect to the lateral direction of the watercraft, and
the first and second recesses of the first and second end portions of the grab bar covering the end portions of the rub rail, respectively.

19. A watercraft comprising:
a watercraft structure including a platform with a recess that vertically extends through the platform at a rear edge of the platform; and
a grab bar mounted to the watercraft structure in the recess of the platform, the grab bar having
a bar portion with a front edge that is disposed forward of the rear edge of the platform with respect to a front to aft direction of the watercraft, and
a mounting portion with a fastener opening for securing the grab bar to a rearwardly facing surface of the recess.

20. A watercraft comprising:
a watercraft structure including
a platform with a recess at a rear edge of the platform, and
a rub rail attached to the platform, the rub rail having end portions that are spaced apart from each other in a lateral direction of the watercraft; and
a grab bar mounted to the watercraft structure in the recess of the platform, the grab bar having
a bar portion with a front edge that is disposed forward of the rear edge of the platform with respect to a front to aft direction of the watercraft, and
first and second end portions with first and second recesses, respectively,
the grab bar being disposed at a center of a rear portion of the watercraft structure with respect to the lateral direction of the watercraft, and
the first and second recesses of the first and second end portions of the grab bar covering the end portions of the rub rail, respectively.

* * * * *